US011502418B2

(12) United States Patent
Angeletti et al.

(10) Patent No.: US 11,502,418 B2
(45) Date of Patent: Nov. 15, 2022

(54) NETWORK FOR FORMING MULTIPLE BEAMS FROM A PLANAR ARRAY

(71) Applicant: European Space Agency, Paris (FR)

(72) Inventors: Piero Angeletti, Noordwijk ZH (NL); Giovanni Toso, Noordwijk ZH (NL)

(73) Assignee: European Space Agency, Paris (FR)

( * ) Notice: Subject to any disclaimer, the term of this patent is extended or adjusted under 35 U.S.C. 154(b) by 17 days.

(21) Appl. No.: 16/972,959

(22) PCT Filed: Jun. 5, 2018

(86) PCT No.: PCT/EP2018/064760
§ 371 (c)(1),
(2) Date: Dec. 7, 2020

(87) PCT Pub. No.: WO2019/233565
PCT Pub. Date: Dec. 12, 2019

(65) Prior Publication Data

US 2021/0249782 A1 Aug. 12, 2021

(51) Int. Cl.
*H01Q 21/00* (2006.01)
*H01Q 21/06* (2006.01)
(Continued)

(52) U.S. Cl.
CPC ..... *H01Q 21/0025* (2013.01); *H01Q 3/40* (2013.01); *H01Q 21/061* (2013.01); *H01Q 21/22* (2013.01); *H01Q 25/00* (2013.01)

(58) Field of Classification Search
CPC ..... H01Q 3/40; H01Q 21/0025; H01Q 3/36; H01Q 21/061; H01Q 1/523;
(Continued)

(56) References Cited

U.S. PATENT DOCUMENTS 8,427,370 B2 * 4/2013 Pozgay ..... H01Q 3/26 342/372
8,451,172 B2 * 5/2013 Angeletti ..... H04B 7/2041 342/373

(Continued)

OTHER PUBLICATIONS

International Search Report for Application No. PCT/EP2018/064760, 15 pgs.

(Continued)

*Primary Examiner* — Vibol Tan
(74) *Attorney, Agent, or Firm* — Seed Intellectual Property Law Group LLP

(57) ABSTRACT

A beamforming network for use with a plurality of antenna elements arranged in a planar array of linear sub-arrays includes first and second sets of beamforming sub-networks. Each beamforming sub-network in the first set of beamforming sub-networks is associated with a respective one of the linear sub-arrays and is adapted to generate, via the associated linear sub-array, fan beams along respective beam directions in a first set of beam directions. Each beamforming sub-network in the second set of beamforming sub-networks is associated with a respective one of the beam directions in the first set of beam directions. For each beamforming sub-network in the second set of beamforming sub-networks, each of the output port is coupled to an input port of a respective beamforming sub-network in the first set of beamforming sub-networks that corresponds to the associated beam direction. The application further relates to a multibeam antenna comprising such beamforming network.

14 Claims, 12 Drawing Sheets

(51) Int. Cl.
*H01Q 21/22* (2006.01)
*H01Q 25/00* (2006.01)
*H01Q 3/40* (2006.01)

(58) Field of Classification Search
CPC .... H01Q 21/0006; H01Q 3/38; H01Q 3/2694; H01Q 3/2664; H01Q 21/0031; H04B 7/0617; H04B 7/0413; H04B 7/0408; H04B 7/0695; H04B 7/0842; G01S 13/4463
See application file for complete search history.

(56) References Cited

U.S. PATENT DOCUMENTS 9,374,145 B2 * 6/2016 Angeletti ..... H04B 7/0691
9,488,720 B2 * 11/2016 Comic ..... G01S 3/74
10,243,412 B1 * 3/2019 Fink ..... H02J 7/025
10,432,273 B1 * 10/2019 Athley ..... H04B 7/0469
10,608,334 B2 * 3/2020 Schuehler ..... H04B 7/0617
10,958,322 B2 * 3/2021 Wang ..... H04B 7/0602
11,245,442 B1 * 2/2022 Foo ..... H04B 7/0413
2007/0285315 A1 12/2007 Davis et al.

OTHER PUBLICATIONS

Von Aulock, W. H., "Properties of Phased Arrays", Proceedings of the IRE, vol. 48, No. 10, pp. 1715-1727, Oct. 1960, 13 pgs.
Angeletti, P. et al., "Beam-Forming Network Developments for European Satellite Antennas", Special Report, Microwave Journal, vol. 50, No. 8, Aug. 2007, 8 pgs.
Betancourt, D. et al., "A Novel Methodology to Feed Phased Array Antennas", IEEE Transactions on Antennas and Propagation, vol. 55, No. 9, Sep. 2007, 6 pgs.

* cited by examiner

NETWORK FOR FORMING MULTIPLE BEAMS FROM A PLANAR ARRAY

BACKGROUND

Technical Field

This disclosure relates to beamforming networks for use with planar arrays of antenna elements and to multibeam (array) antennas comprising such beamforming networks. The disclosure is particularly applicable to beamforming networks and multibeam antennas for microwave systems.

Description of the Related Art

In many microwave systems it is desirable to generate multibeam beams to cover a given field of view with increased gain and isolation between areas covered by different beams. A Beam Forming Network (BFN) plays an essential role in Direct Radiating Arrays (DRAs) antenna architectures, as described, e.g., in P. Angeletti, M. Lisi, "Beam-Forming Network Developments for European Satellite Antennas", (Special Report), Microwave Journal, Vol. 50, No. 8, August 2007. A beamforming network may perform the functions of, in an emitting antenna array, focusing the energy radiated by an array along one or more predetermined directions in space by opportunely phasing and weighting the signals feeding the radiating elements of the array and/or, in a receiving antenna array, synthesizing one or more receiving lobes having predetermined directions in space by opportunely phasing and weighting the signals received by the antenna elements of the array.

A fully reconfigurable beamforming network driving all the antenna elements (radiating elements) of the array for generating a high number of independent beams with maximum flexibility would imply a degree of complexity that would make it impractical for many applications. Simpler solutions retaining sufficient (although not necessarily complete) flexibility are therefore desirable.

Furthermore, to reduce the complexity of array antennas in terms of number of elements and to improve the spatial isolation performances in terms of side-lobes and grating-lobes, design techniques exploiting aperiodic element positions and non-identical element dimensions have been introduced. For such sparse array configurations, techniques for decomposing the beamforming network in lower complexity beamforming networks are not known.

An example of a conventional fully interconnected beamforming network driving N antenna elements for generating M independent beams with maximum flexibility is shown in FIG. 1. This beamforming network requires M signal dividers 101-1, 101-2, . . . , 101-M (or combiners, in a receiving application) of order 1:N, N signal combiners 102-1, 102-2, . . . , 102-N (or dividers, in the receiving application) of order M:1, and, most of all, N×M phase shifters 103-1-1, . . . , 103-1-N, . . . , 103-M-1, . . . , 103-M-N (and possibly variable attenuators). The complexity of this beamforming network would make it impractical for many applications. Simpler solutions retaining sufficient (although not necessarily complete) flexibility are therefore desirable.

However, conventional techniques for addressing this issue are limited to periodic planar arrays (with a rectangular or triangular base) and generate a periodic lattice of identical beams in the direction cosine plane with lattice base vectors constrained to be aligned to the reciprocal of the element base vectors.

BRIEF SUMMARY

The present disclosure recognizes there is a need for an efficient, modular, and scalable design for beamforming networks capable of supporting planar array configurations arranged in arrays of linear sub-arrays. There is particular need for such beamforming networks that support planar array configurations in which the linear sub-arrays can be different from each other, e.g., identical within groups and different between groups, and/or in which each of the linear sub-arrays can be periodic, a thinned version of a periodic sub-array, or aperiodic (e.g., having inter-element distances that are not commensurable), and/or in which the array of linear sub-arrays itself can be periodic, a thinned version of a periodic array, or aperiodic.

There is further need for reducing the complexity of the beamforming network. There is yet further need for a beamforming network that allows for added flexibility in the angular positions and dimensions of the beams to be generated.

In view of some or all of these needs, the present disclosure proposes a beamforming network and a multibeam antenna having the features described and/or claimed herewith.

An aspect of the disclosure relates to a beamforming network for use with a plurality of antenna elements (radiating elements) that are arranged in a planar array of linear sub-arrays. The array may be an array of parallel linear sub-arrays, for example. The plurality of antenna elements may be said to form an array antenna. The beamforming network may include a first set of beamforming sub-networks and a second set of beamforming sub-networks. Each beamforming sub-network may implement a respective beamforming matrix. Each beamforming sub-network in the first set of beamforming sub-networks may be associated with a respective one of the linear sub-arrays and may have a first number of output ports corresponding to the number of antenna elements in the associated linear sub-array. Accordingly, there may be one beamforming sub-network in the first set of beamforming sub-networks for each of the linear sub-arrays (i.e., there may be a one-to-one relationship between the linear sub-arrays and the beamforming sub-networks among the first set of beamforming sub-networks). Each of the output ports may be adapted to be coupled to a respective one of the antenna elements in the respective linear sub-array. The output ports of each beamforming sub-network among the first set of beamforming sub-networks may be ordinately connected (or connectable) to the antenna elements in its associated linear sub-array. The output ports of the beamforming sub-networks in the first set of beamforming sub-networks may be referred to as element ports, or more specifically, used element ports. Notably, the beamforming sub-networks in the first set of beamforming sub-networks may have additional output ports that may be terminated.

Each beamforming sub-network in the first set of beamforming sub-networks may be adapted to generate, via its associated linear sub-array, fan beams along respective beam directions in a first set of beam directions. Each beamforming sub-network in the first set of beamforming sub-networks may have a second number of input ports. The fan beams may lie in respective planes that intersect the planar array in a line that extends in perpendicular to the direction of the linear sub-arrays. Respective beam directions of the fan beams may lie in a plane that contains the respective associated linear sub-array and that is perpendicular to the planar array.

Each of the second number of input ports may correspond to a respective beam direction in the first set of beam directions. The input ports of the beamforming sub-networks in the first set of beamforming sub-networks may be referred to as beam ports, or more specifically, used beam ports. Notably, the beamforming sub-networks in the first set of beamforming sub-networks may have additional input ports that may be terminated.

The number of beamforming sub-networks in the second set of beamforming sub-networks may correspond to the number of beam directions in the first set of beam directions. Each beamforming sub-network in the second set of beamforming sub-networks may be associated with a respective one among the beam directions in the first set of beam directions.

Each beamforming sub-network in the second set of beamforming sub-networks may have a third number of (used) output ports corresponding to the number of beamforming sub-networks in the first set of beamforming sub-networks. Notably, the beamforming sub-networks in the second set of beamforming sub-networks may have additional output ports that may be terminated. For each beamforming sub-network in the second set of beamforming sub-networks, each of the output ports may be coupled (e.g., connected) to that input port of a respective beamforming sub-network in the first set of beamforming sub-networks that corresponds to the associated beam direction.

In the beamforming network for a direct radiating array described above, the first set of beamforming sub-networks and the second set of beamforming sub-networks are arranged in a cascaded configuration. That is, the beamforming network is decomposed into a cascade of two sets of beamforming sub-networks with simplified interconnectivity between the radiating elements, the first set of beamforming sub-networks, and the second set of beamforming sub-networks, thereby achieving a significant complexity reduction. At the same time, the proposed beamforming network allows for large flexibility in the angular positions (steering directions) and dimensions (widths) of the beams to be generated.

Moreover, the proposed beamforming network has several advantages in terms of flexibility with regard to the types of direct radiating arrays it can be used with. Namely, the proposed beamforming network is applicable to arrays of linear sub-arrays that can be identical to each other or different from each other, or identical within groups and different between groups. Each of the linear sub-arrays can be periodic, a thinned version of a periodic sub-array, or aperiodic. Further, the array of linear sub-arrays itself can be periodic, a thinned version of a periodic array, or aperiodic.

Finally, the proposed beamforming network has a large number of possible applications, such as multibeam generation of a high number of beams for a geostationary satellite communication system, or multibeam generation of a high number of beams with optimized beam dimensions for a low Earth orbit satellite communication system, for example.

In some embodiments, for each beamforming sub-network in the first set of beamforming sub-networks, a gradient of the transmission phase between a given input port and a given output port may be constant along the direction of the respective associated linear sub-array. In other words, for a given input port, a ratio between a difference between transmission phases associated with a pair of output ports and a difference between the locations, along the sub-array direction, of the antenna elements associated with this pair of output ports may be constant, i.e., may be the same for different pairs of output ports.

For example, for each beamforming sub-network in the first set of beamforming sub-networks, the transmission phase between a given input port and a given output port of the beamforming sub-network may depend linearly on a position, along a direction extending in parallel to the linear sub-arrays, of the respective antenna element that is coupled to that output port. This can be implemented if, for example, for a q-th beamforming sub-network in the first set of beamforming sub-networks the transmission phase $\varphi_{p,q|m_1,q}^{(1)}$ between an $m_1$-th input port and an output port coupled to the p-th antenna element in the associated linear sub-array is given by $\varphi_{p,q|m_1,q}^{(1)}=c_{m_1}(x_{p,q}-x_{0q})+\vartheta_{m_1,q}$ where $c_{m_1}$ is a constant depending on the beam direction to which the $m_1$-th input port corresponds, $x_{p,q}$ is the position of the p-th antenna element in the q-th linear sub-array, $x_{0q}$ is a reference position for the q-th linear sub-array (e.g., a sub-array reference phase center), and $\vartheta_{m_1,q}$ is a transmission phase offset. In more concrete terms, the transmission phase may be given by $\varphi_{p,q|m_1,q}^{(1)}=k_0u_{m_1}(x_{p,q}-x_{0q})+\vartheta_{m_1,q}$, where $k_0$ is a wave number and $u_{m_1}$ corresponds to a direction cosine of the beam direction to which the $m_1$-th input port corresponds. By appropriate choice of the gradient(s), the steering directions of the fan beams generated by the beamforming sub-networks in the first set of beamforming sub-networks can be adjusted as desired.

In some embodiments, for each beamforming sub-network in the second set of beamforming sub-networks, a gradient of the transmission phase between a given input port and a given output port may be constant along a direction perpendicular to the directions of the linear sub-arrays. In other words, for a given input port, a ratio between a difference between transmission phases associated with a pair of output ports and a difference between the locations, along a direction perpendicular to the sub-array direction, of the linear sub-arrays associated with the beamforming sub-networks in the first set of beamforming sub-networks that are coupled to this pair of output ports may be constant, i.e., may be the same for different pairs of output ports. For example, for each beamforming sub-network in the second set of beamforming sub-networks, the transmission phase between a given input port and a given output port of the beamforming sub-network may depend linearly on a position, along a direction extending in perpendicular to the linear sub-arrays, of the linear sub-array associated with the beamforming sub-network in the first set of beamforming sub-networks that is coupled to the given output port.

In some embodiments, each beamforming sub-network in the second set of beamforming sub-networks may be adapted to generate, via the beamforming sub-networks in the first set of beamforming sub-networks and their associated linear sub-arrays, fan beams along respective beam directions in a second set of beam directions. Each of the input ports of the beamforming sub-networks in the second set of beamforming sub-networks may correspond to a respective beam direction in the second set of beam directions. For an $m_1$-th beamforming sub-network in the second set of beamforming sub-networks, the transmission phase $\varphi_{m_1,q|m_1,m_2}^{(2)}$ between an $m_2$-th input port and an output port coupled to the beamforming sub-network in the first set of beamforming sub-networks that is associated with a q-th linear sub-array may be given by $\varphi_{m_1,q|m_1,m_2}^{(2)}=-c_{m_1,m_2}y_q+\varphi_{m_1,m_2}$ where $c_{m_1,m_2}$ is a constant depending on a beam direction to which the $m_2$-th input port corresponds, $y_q$ is the position of the q-th linear sub-array in a direction perpendicular to the linear sub-arrays, and $\varphi_{m_1,m_2}$ is a transmission phase offset. In more concrete terms, the transmission phase may be given by $\varphi_{m_1,q|m_1,m_2}^{(2)}=k_0v_{m_1,m_2}y_q+\varphi_{m_1,m_2}$, where $k_0$ is a wave number and $v_{m_1,m_2}$ corresponds to a direction cosine of the beam direction to which the $m_2$-th input port corresponds. By appropriate choice of the gradient(s), the steering directions of the fan beams generated by the beamforming sub-networks in the second set of beamforming sub-networks, and thereby the steering directions of the resulting beams, can be adjusted as desired.

Another aspect of the disclosure relates to a multibeam antenna comprising the plurality of antenna elements and the beamforming network of the aforementioned aspect and its embodiments. The output ports of each beamforming sub-network in the first set of beamforming sub-networks may be coupled to respective corresponding antenna elements.

In some embodiments, the array may be a sparse array. For example, the linear sub-arrays may be arranged at positions in a direction extending in perpendicular to the linear sub-arrays that are integer multiples of a predetermined sub-array spacing, wherein at least some positions corresponding to integer multiples are empty.

In some embodiments, at least one of the linear sub-arrays may be a sparse array. For example, the antenna elements may be arranged at positions in a direction extending in parallel to the linear sub-array that are integer multiples of a predetermined element spacing, wherein at least some positions corresponding to integer multiples are empty.

In some embodiments, at least two of the linear sub-arrays may be different from each other. For example, the linear sub-arrays may be subdivided into two or more groups of linear sub-arrays. Then, linear sub-arrays may be identical to each other within groups of linear sub-arrays but different from each other between groups of linear sub-arrays.

In some embodiments, each linear sub-array may be one of periodic, thinned periodic, or aperiodic. Likewise, the array of linear sub-arrays may be one of periodic, thinned periodic, or aperiodic.

Accordingly, a multibeam antenna according to embodiments of the disclosure allows for a great amount of flexibility in designing the antenna array that is formed by the plurality of antenna elements. In particular, the antenna array is not required to be periodic or otherwise regular. In fact, the beamforming network described above can accommodate for arbitrary inter-element spacings along each linear sub-array as well as for arbitrary inter-array spacings between the linear sub-arrays and still achieve a desired beam steering pattern.

It will be appreciated that method steps and apparatus or system features may be interchanged in many ways. In particular, the details of the disclosed method can be implemented by an apparatus or system, and vice versa, as the skilled person will appreciate. Moreover, any of the above statements made with respect to methods are understood to likewise apply to apparatus and systems, and vice versa.

It is also understood that in the present document, the term "couple" or "coupled" refers to elements being in electrical communication with each other, whether directly connected, e.g., via wires, or in some other manner (e.g., indirectly). Notably, one example of being coupled is being connected.

BRIEF DESCRIPTION OF THE SEVERAL VIEWS OF THE DRAWINGS

Example embodiments of the disclosure are explained below with reference to the accompanying drawings, wherein.

DETAILED DESCRIPTION

In the following, example embodiments of the disclosure will be described with reference to the appended figures. Identical elements in the figures may be indicated by identical reference numbers, and repeated description thereof may be omitted.

First Embodiment

Figure 1:
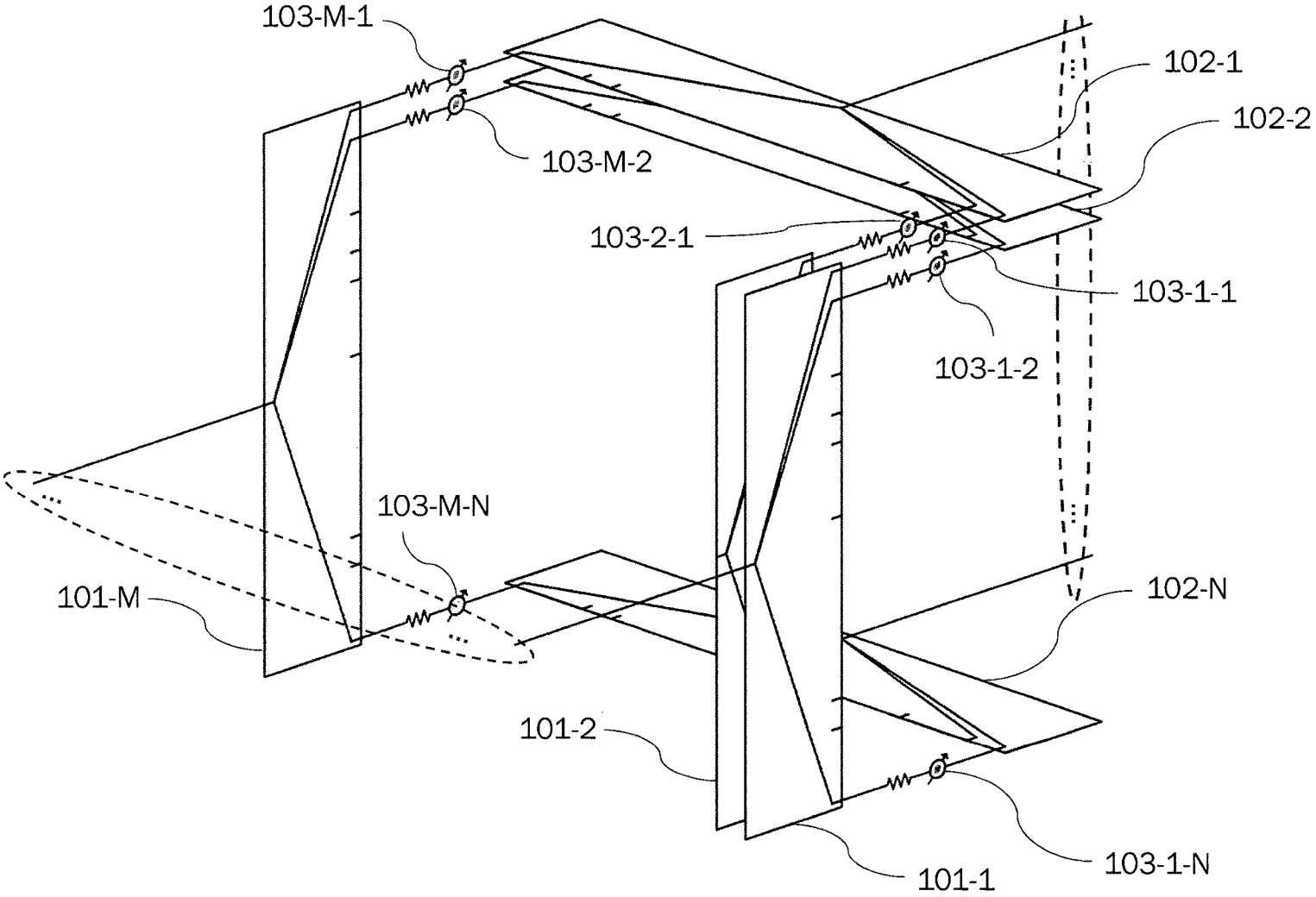
FIG. 1 schematically illustrates an example of a fully interconnected beamforming network, FIG. 2A schematically illustrates an example of a layout of an array antenna according to embodiments of the present disclosure, FIG. 2B schematically illustrates an example of a beam steering direction of a steered beam and associated variables according to embodiments of the disclosure, FIG. 3 schematically illustrates an example of an interconnection between a first set of beamforming sub-networks and linear sub-arrays of the array antenna of FIG. 2A according to embodiments of the disclosure, FIG. 4 schematically illustrates an example of an interconnection between a second set of beamforming sub-networks and the arrangement of FIG. 3 according to embodiments of the disclosure, FIG. 5 schematically illustrates an example of beam steering directions of fan beams generated by the beamforming sub-networks in the first set of beamforming sub-networks in association with the linear sub-arrays of the array antenna according to embodiments of the disclosure, FIG. 6 schematically illustrates an example of beam steering directions of fan beams generated by an $m_1$-th beamforming sub-network in the second set of beamforming sub-networks in association with the beamforming sub-networks in the first set of beamforming sub-networks and the linear sub-arrays of the array antenna according to embodiments of the disclosure, FIG. 7 schematically illustrates an example of resulting beam steering directions for the beams generated by the beamforming sub-networks in the first and second sets of beamforming sub-networks interconnected as shown in FIG. 4 for the beam steering directions shown in FIG. 5 and FIG. 6, FIG. 8A schematically illustrates a direct radiating array with square elements disposed on a periodic array with square base according to embodiments of the disclosure, FIG. 8B schematically illustrates an example of a beamforming network for use with the direct radiating array of FIG. 8A, according to embodiments of the disclosure, FIG. 9A and FIG. 9B schematically illustrate examples of the multibeam coverages generated by a beamforming network according to embodiments of the disclosure, FIG. 10A schematically illustrates an example of beam steering directions and beam widths generated by the first set of beamforming sub-networks according to embodiments of the disclosure, FIG. 10B schematically illustrates an example of beam steering directions and beam widths generated by the $m_1$-th beamforming sub-network in the second set of beamforming sub-networks according to embodiments of the disclosure, and FIG. 11 schematically illustrates an example of a resulting beam pattern for optimized design variables according to embodiments of the disclosure.
Figure 2A:
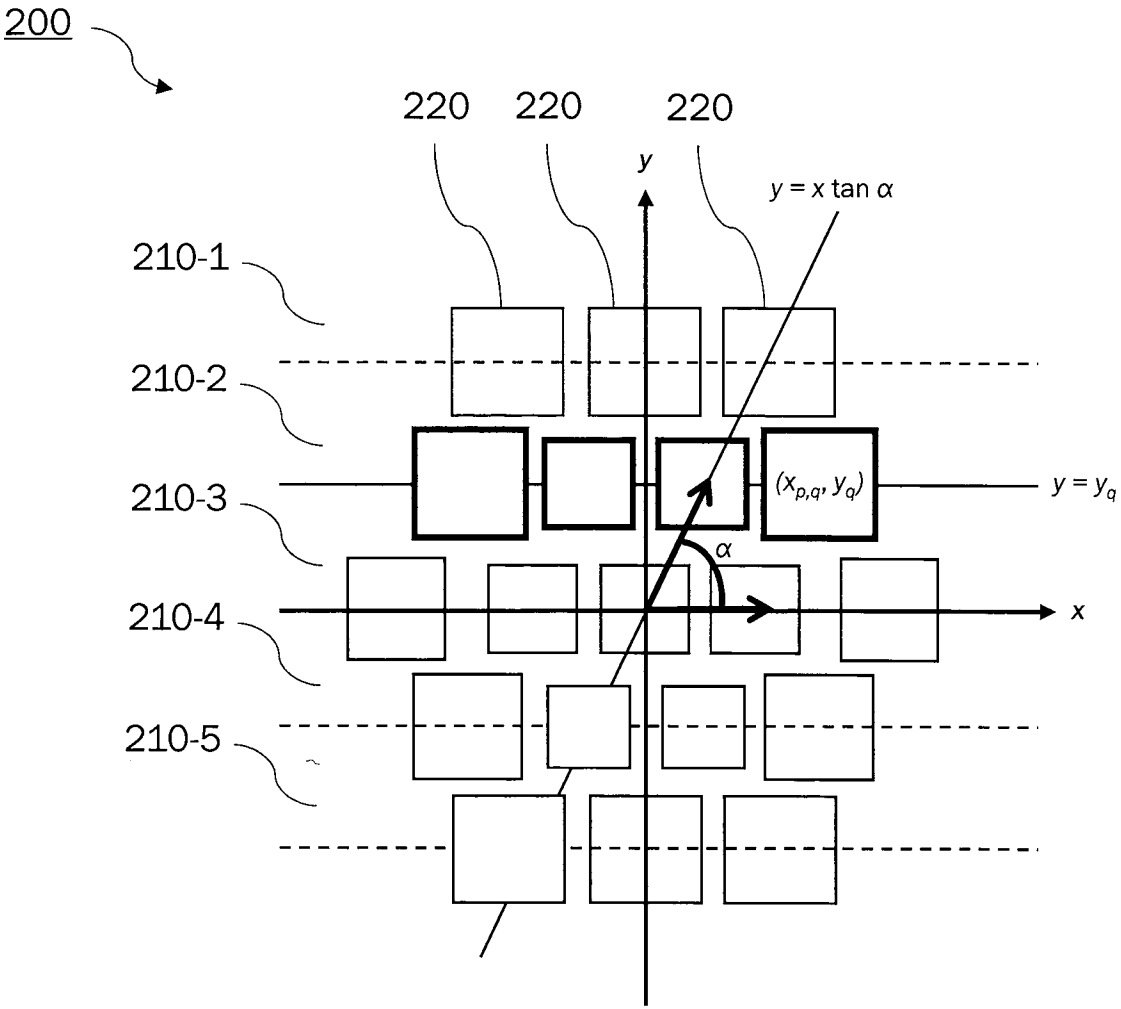

A generic planar array antenna (AA) for use by the embodiments of the disclosure is composed of a set of N radiating elements (REs) placed in the positions $r_n$ (disposed on the x-y plane) and excited by complex weights w(n). An example of the array geometry is schematically illustrated in FIG. 2A. The array antenna 200 in the example comprises a plurality of antenna elements (radiating elements, or elements for short) 200 that are arranged in a planar array of linear sub-arrays 210-1, . . . , 210-5. The linear sub-arrays 210 are arranged in parallel to each other and are assumed to extend in parallel to the x axis in the example.

The array factor AF(u, v) can be evaluated by means of a Fourier transform of the array discrete field p(r) via $$p(r)=\Sigma_{n=1}^{N}w(n)\delta(r-r_n) \tag{1}$$

$$AF(u,v)=\Sigma_{n=1}^{N}w(n)\exp(jk_0\hat{k}\cdot r_n) \tag{2}$$

where δ(r) is the Dirac delta function and $$r=\hat{x}x+\hat{y}y \tag{3}$$

$$r_n=\hat{x}x_n+\hat{y}y_n \tag{4}$$

$$k_0=\frac{2\pi}{\lambda} \tag{5}$$

$$\hat{k}=\hat{x}u+\hat{y}v+\hat{z}w=\hat{x}\sin\vartheta\cos\varphi+\hat{y}\sin\vartheta\sin\varphi+\hat{z}\cos\vartheta=\hat{x}u+\hat{y}v+\hat{z}\sqrt{1-u^2-v^2} \tag{6}$$

Assuming that the antenna array is planar and that the antenna elements lie in the x-y plane, it is sufficient to consider for the scalar product $\hat{k}\cdot r_n$ in Equation (2) the projection $u=k_\perp$ of the steering vector k on the x-y plane, $$u=k_\perp=\hat{x}\sin\varepsilon\cos\varphi+\hat{y}\sin\varepsilon\sin\varphi=\hat{x}u+\hat{y}v \tag{7}$$

Figure 2B:
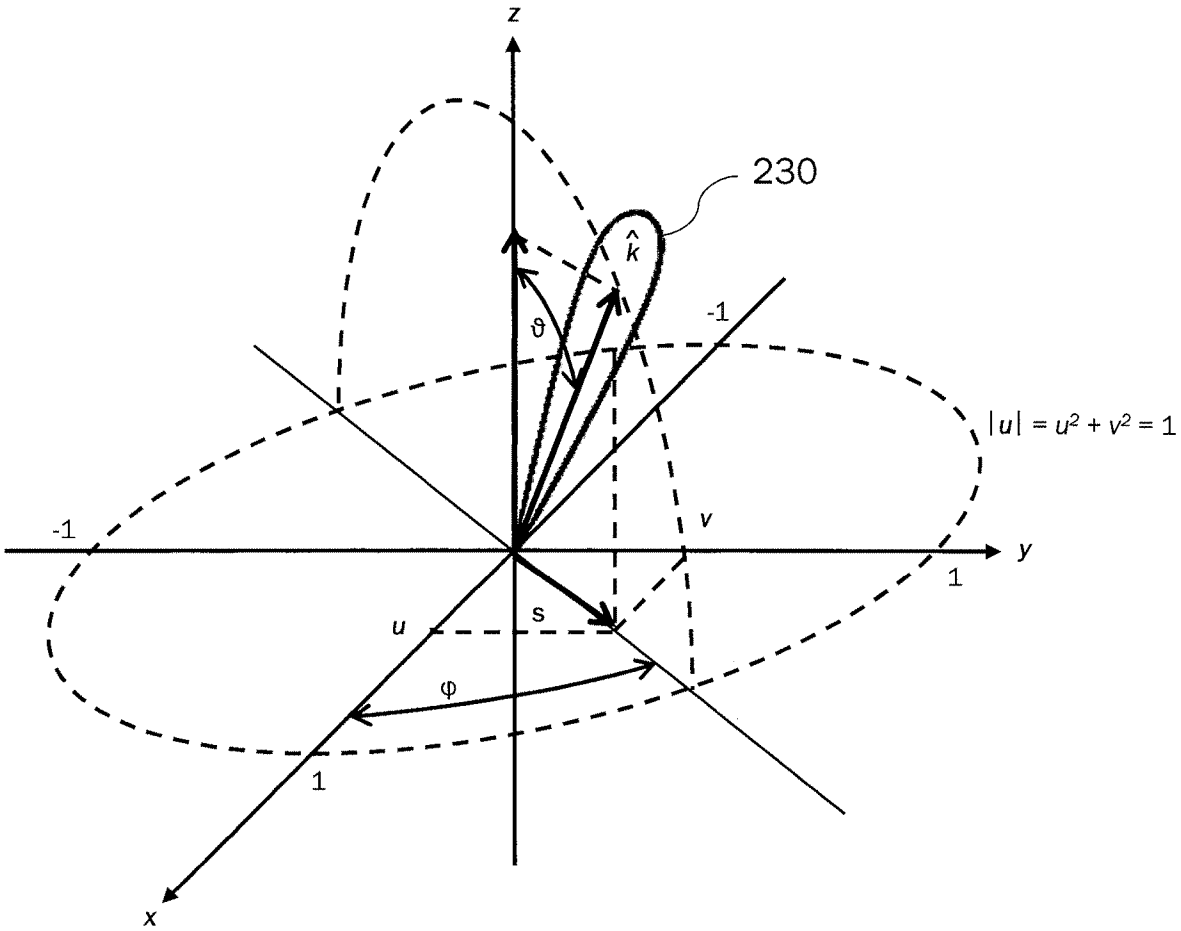

The u,v-plane, sometimes called the direction cosine plane, was first developed by Von Aulock (W. H. Von Aulock, "Properties of Phased Arrays," in Proceedings of 25 the IRE, vol. 48, no. 10, pp. 1715-1727, October 1960) and is useful for understanding planar array scanning performances. Indeed, in this space the array factor $$AF(u)=\Sigma_{n=1}^{N}w(n)\exp(jk_0u\cdot r_n) \tag{8}$$

remains invariant under scanning and merely undergoes a translation proportional to the phase delay between adjacent radiators. This property represents one of the most advantageous features of array antennas in performing beam scanning. Defining a prototypal beam with an excitation set $w_0(n)$ and an array factor as defined in Equation (2), pointed to the broadside direction $s_0\equiv(u_0, v_0)=(0,0)$, the new set of excitations, w(n, s) for scanning the beam to the direction $s\equiv(u_1, v_1)$ can be derived from the excitation set $w_0(n)$ via $$w(n,s)=w_0(n)\cdot\exp(-jk_0s\cdot r_n) \tag{9}$$

where the steering factor $\exp(-jk_0s\cdot r_n)$ represents the phase correction required to align the array phase-front with respect to the pointing direction s. An example of the beam steering geometry and involved variables for a beam pointing in the direction of the steering vector s for a steered beam 230 is schematically illustrated in FIG. 2B.

The steering vector s carries information equivalent to the angles ϑ and ϕ formed by the beam pointing direction and the z axis and the x axis, respectively.

Examining the steering factor $\exp(-jk_0s\cdot r_n)$, it is clear that the direction of the beam pointing is determined by the direction (changed in sign) of the phase gradient across the aperture (i.e., across the array antenna). In the simple case of a linear (sub-)array, $r_n=\hat{x}x_n$, the direction of the phase gradient is in line with the elements of the array, $\hat{s}=\hat{x}$ and its magnitude is expressed by $$s\cdot\hat{x}=-\frac{1}{k_0}\frac{\Delta\varphi}{\Delta x}.$$

Given a linear array with N radiating elements placed in the positions $r_n=\hat{x}x_n$ one can introduce a multibeam beamforming network with M beam ports such that the phase transmission matrix between the beam ports (e.g., inputs) and the element ports (e.g., outputs) is given by the rectangular matrix $$T=\begin{bmatrix} e^{j\varphi_{1|1}} & e^{j\varphi_{1|2}} & \cdots & e^{j\varphi_{1|M}} \\ e^{j\varphi_{2|1}} & e^{j\varphi_{2|2}} & & e^{j\varphi_{2|M}} \\ \vdots & & \ddots & \\ e^{j\varphi_{N|1}} & e^{j\varphi_{N|2}} & & e^{j\varphi_{N|M}} \end{bmatrix} \tag{10}$$

To obtain the desired beam steering, the phase gradient between element ports (rows) must be constant for each beam port (column), i.e., $$-\frac{1}{k_0}\left(\frac{\varphi_{n|m}-\varphi_{(n-1)|m}}{x_n-x_{(n-1)}}\right)=u_m \tag{11}$$

These conditions are satisfied by phase entries of the form $$\varphi_{n|m}=-k_0\mu_m(x_n-x_0)+\vartheta_m \tag{12}$$

where $x_0$ is a reference position within the linear array of radiating elements (e.g., the reference phase center of the linear array). The inter-element spacings of the linear array do not need to be constant (i.e., the array does not need to be periodic). For example, the array could be a thinned version of a periodic array, or an aperiodic array. It is important to note that Equation (12) can be satisfied regardless of periodicity of the linear array.

Next, an array of Q multibeam linear sub-arrays is considered, where each linear sub-array is (without intended limitation) aligned in parallel to the x axis and is labelled with the index q=1, . . . , Q. The q-th linear sub-array comprises (e.g., is composed by) P(q) radiating elements with the radiating elements distributed along a line parallel to the x axis crossing they axis at the coordinate $y_q$. The P(q) radiating elements of the q-th linear sub-array are disposed on the positions $x_{p,q}$. An example of such array of linear sub-arrays is shown in FIG. 2A.

In general, the linear sub-arrays can be identical to each other or different from each other. That is, at least two linear sub-arrays can be different from each other (e.g., with respect to the number of their elements and/or their inter-element spacings). Further, linear sub-arrays can be identical within groups and different between groups. Each of the linear sub-arrays can be periodic, a thinned version of a periodic linear sub-array, or aperiodic (i.e., inter-element distances may not be commensurable). For example, each (e.g., at least one) of the linear sub-arrays can be a sparse array. Also the spacings between adjacent linear sub-arrays in the direction of the y axis do not need to be constant. The array (of linear sub-arrays) can be periodic, a thinned version of a periodic array, or aperiodic. For example, the array (of linear sub-arrays) can be a sparse array.

The overall array will be composed of N radiating elements, where $$N=\Sigma_{q=1}^{Q}P(q) \tag{13}$$

$$r_{p,q}=\hat{x}x_{p,q}+\hat{y}y_q,\ p=1,\ldots,P(Q),\ q=1,\ldots,Q \tag{14}$$

The present disclosure relates to a beamforming network for such arrays of radiating elements (antenna elements) that are arranged in a planar array of linear sub-arrays. As described above, the array can be an array of parallel linear sub-arrays. Arranged in such a configuration, the plurality of radiating elements may be said to form an array antenna.

The beamforming network comprises a first set of beamforming sub-networks 10 and a second set of beamforming sub-networks 20 that are arranged in a cascaded configuration, as will be described below.

Figure 3:
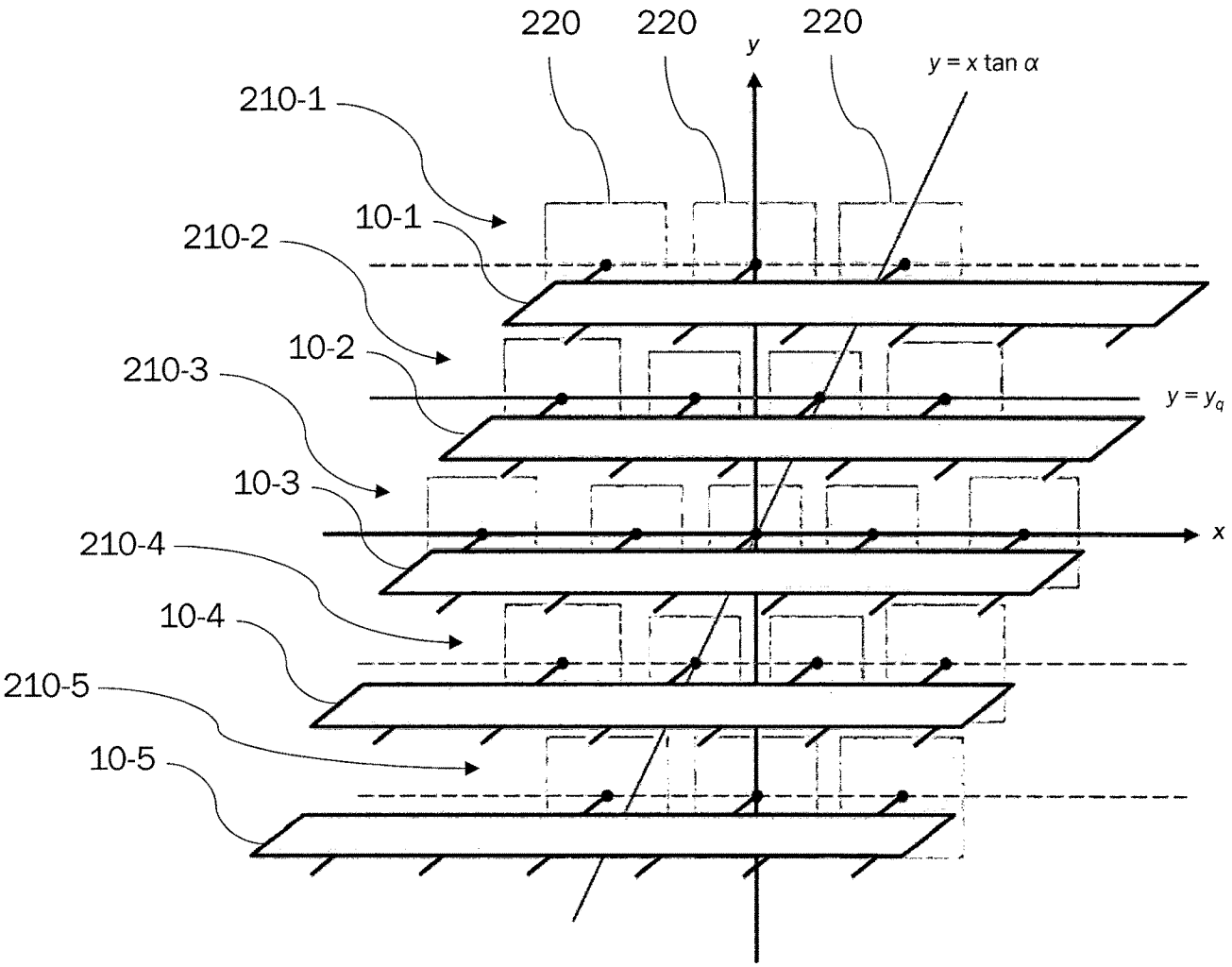

The linear sub-arrays 210 are individually interconnected to the first set of beamforming sub-networks 10. An example of an array antenna 200 comprising an arrangement of linear sub-arrays 210-1, . . . , 210-5 of antenna elements 220 and associated beamforming sub-networks 10-1, . . . , 10-5 is schematically illustrated in FIG. 3. As can be seen from that figure, each beamforming sub-network 10 in the first set of beamforming sub-networks is associated with a respective one of the linear sub-arrays 210. That is, there is one beamforming sub-network 10 in the first set of beamforming sub-networks for each of the linear sub-arrays 210 (i.e., there is a one-to-one relationship between the linear sub-arrays 210 and the beamforming sub-networks 10 among the first set of beamforming sub-networks).

Further, each beamforming sub-network 10 in the first set of beamforming sub-networks has a first number of (used) output ports corresponding to the number of antenna elements in the associated linear sub-array 210. For example, beamforming sub-network 10-1 in FIG. 3 has 3 used output ports. However, each beamforming sub-network 10 may have additional output ports that are terminated and not coupled to one of the antenna elements 220.

The output ports may be referred to as element ports (or more specifically, used element ports). The output ports are coupled to respective antenna elements in the linear sub-array. More specifically, the output ports of each beamforming sub-network 10 among the first set of beamforming sub-networks are ordinately connected to the antenna elements 220 in its associated linear sub-array 210. That is, the first output port is coupled to the first antenna element 220 in the linear sub-array 210, the second output port is coupled to the second antenna element in the linear sub-array 210, and so forth.

The beamforming sub-networks 10 in the first set of beamforming sub-networks implement respective beamforming matrices that are collimated to generate a first set of $M_1$ fan beams along the direction cosine coordinates $u=u_{m_1}$ with $1 \le m_1 \le M_1$. Thus, each beamforming sub-network 10 in the first set of beamforming sub-networks is adapted to generate, via its associated linear sub-array 210, fan beams along respective beam directions $u_{m_1}$ in a first set of beam directions $\{u_1, u_{M_1}\}$. Correspondingly, each beamforming sub-network 10 in the first set of beamforming sub-networks has a second number $M_1$ of (used) input ports, wherein each of the (used) input ports corresponds to a respective beam direction in the first set of beam directions $\{u_1, \ldots, u_{M_1}\}$. However, each beamforming sub-network 10 may have additional input ports that are terminated. The input ports of the beamforming sub-networks 10 in the first set of beamforming sub-networks may be referred to as beam ports (or more specifically, used beam ports).

Throughout this disclosure, the terms beamforming matrix and beamforming sub-network may be used interchangeably, unless indicated otherwise.

Figure 5:
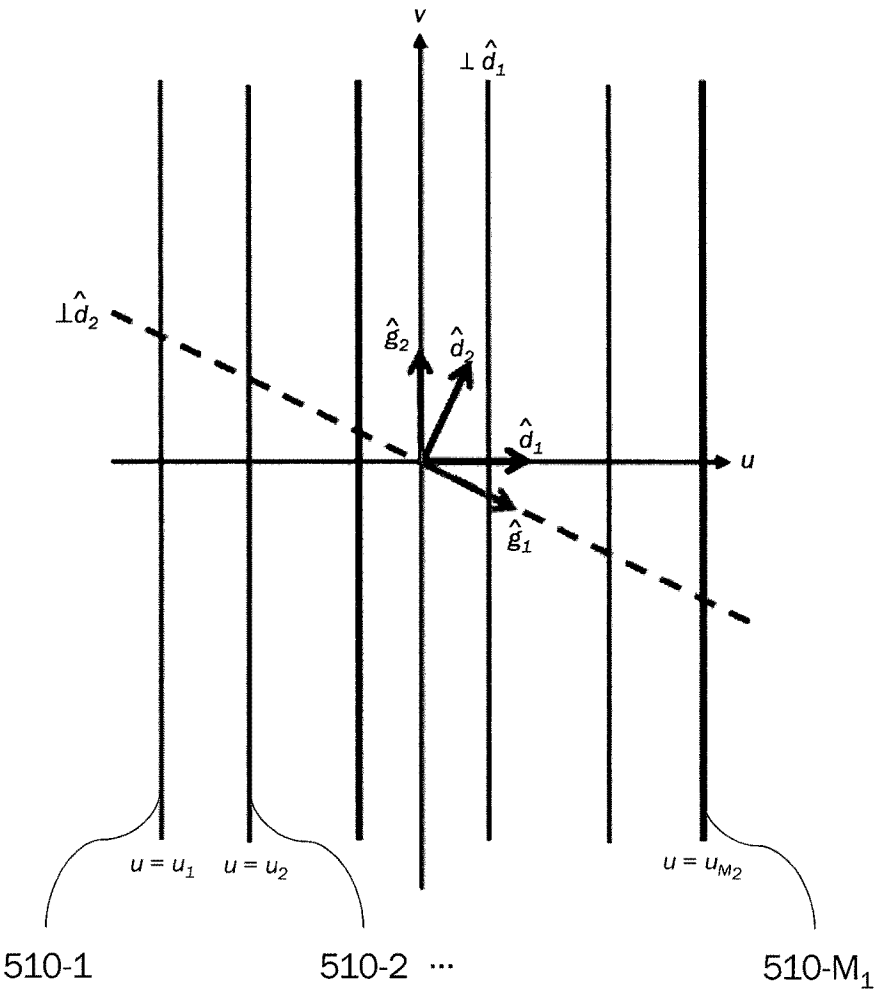

An example of the $M_1$ fan beams 510-1, . . . , 510-$M_1$ is illustrated in FIG. 5. The $M_1$ fan beams may lie in respective planes that intersect the planar array 200 in a line that extends in perpendicular to the direction of the linear sub-arrays 210. Respective beam directions (steering directions) of the fan beams may lie in a plane that contains the respective associated linear sub-array 210 and that is perpendicular to the planar array 200.

As noted above, the q-th beamforming matrix of the first set of beamforming matrices interconnecting the q-th linear sub-array has a number of used inputs equal to $M_1$ and a number of used outputs equal to P(q). The inputs are labelled $m_1=1, \ldots, M_1$ and the outputs are labelled p=1, . . . , P(q). The outputs are ordinately interconnected to radiating elements of the q-th linear sub-array with positions $r_{p,q} \equiv \hat{x}x_{p,q}+\hat{y}y_q$.

For each beamforming sub-network 10 in the first set of beamforming sub-networks, a gradient (with respect to a location of associated antenna elements along the linear sub-array, e.g., with respect to the x coordinate) of the transmission phase between a given input port and a given output port is constant along the direction of the respective associated linear sub-array (i.e., when going from one antenna element to another, e.g., along the x axis). That is, defining the transmission phase between the $m_1$-th input port of the q-th beamforming sub-network 10-*q* in the first set of beamforming sub-networks and the p-th output port of the q-th beamforming sub-network 10-*q* as $\varphi_{p,q|m_1,q}^{(1)}$, the gradient $(\varphi_{p,q|m_1,q}^{(1)}-\varphi_{p-1,q|m_1,q}^{(1)})/(x_{p,q}-x_{p-1,q})$ is constant along the x axis (wherein the x axis is an example of the extending direction of the linear sub-arrays 210). That is, this gradient is independent of the output port number p. The additional index q is introduced both for inputs and outputs to obtain a unique and ordered addressing of the input and outputs of the first set of beamforming matrices.

For example, for each beamforming sub-network 10 in the first set of beamforming sub-networks, the transmission phase between a given input port and a given output port of the beamforming sub-network 10 may depend linearly on a position, along a direction extending in parallel to the linear sub-arrays 210, of the respective antenna element 220 that is coupled to that output port. In other words, $\varphi_{p,q|m_1,q}^{(1)} \propto x_{p,q}$. This is the case if, for a q-th beamforming sub-network 10-*q* in the first set of beamforming sub-networks, the transmission phase $\varphi_{p,q|m_1,q}^{(1)}$ between an $m_1$-th input port and an output port coupled to the p-th antenna element in the associated linear sub-array 210-*q* is given by $\varphi_{p,q|m_1,q}^{(1)}=-c_{m_1}(x_{p,q}-x_{0q})+\vartheta_{m_1,q}$ where $c_{m_1}$ is a constant depending on the beam direction $u_{m_1}$ to which the $m_1$-th input port corresponds, $x_{p,q}$ is the position of the p-th antenna element in the q-th linear sub-array, $x_{0q}$ is a reference position for the q-th linear sub-array (e.g., the reference phase center of the linear sub-array), and $\varepsilon_{m_1,q}$ is a transmission phase offset.

In a preferred implementation, the transmission phase between the beam port $m_1$ and the element ports p of said q-th beamforming matrix is given by $$\varphi_{p,q|m_1,q}^{(1)}=-k_0 u_{m_1}(x_{p,q}-x_{0q})+\vartheta_{m_1,q} \tag{15}$$

The reference position $x_{0q}$ may be referred to as sub-array reference phase center.

Assuming now (without intended limitation) that each q-th sub-array is linear and aligned along a line parallel to the x axis, and assuming the phase excitations to be given by Equation (15), each sub-array excited at the input port $m_1$ would generate a fan beam steered along the direction $u_{m_1}$. The input ports of the beamforming networks of the first set of beamforming networks having same port label $m_1$ are considered homologue (in the sense that they generate collimated beams from different sub-arrays).

The first set of beamforming sub-networks (beamforming matrices) 10 is interconnected to a second set of beamforming sub-networks (beamforming matrices) 20, wherein a beamforming sub-network 20 of the second set of beamforming sub-networks is interconnected (coupled) to all homologue input ports of the first set of beamforming sub-networks 10. An example of such arrangement is schematically illustrated in FIG. 4.

The number of beamforming sub-networks of the second set of beamforming sub-networks is equal to the number $M_1$ of fan beams generated by each beamforming sub-network of the first set of beamforming matrices and said beamforming sub-networks are labelled $m_1=1, \ldots, M_1$. In other words, the number of beamforming sub-networks 20 in the second set of beamforming sub-networks corresponds to the number of beam directions $u_{m_1}$ in the first set of beam directions $\{u_1, \ldots, u_{M_1}\}$. Each beamforming sub-network 20 in the second set of beamforming sub-networks is associated with a respective one among the beam directions in the first set of beam directions $\{u_1, \ldots, u_{M_1}\}$.

Figure 4:
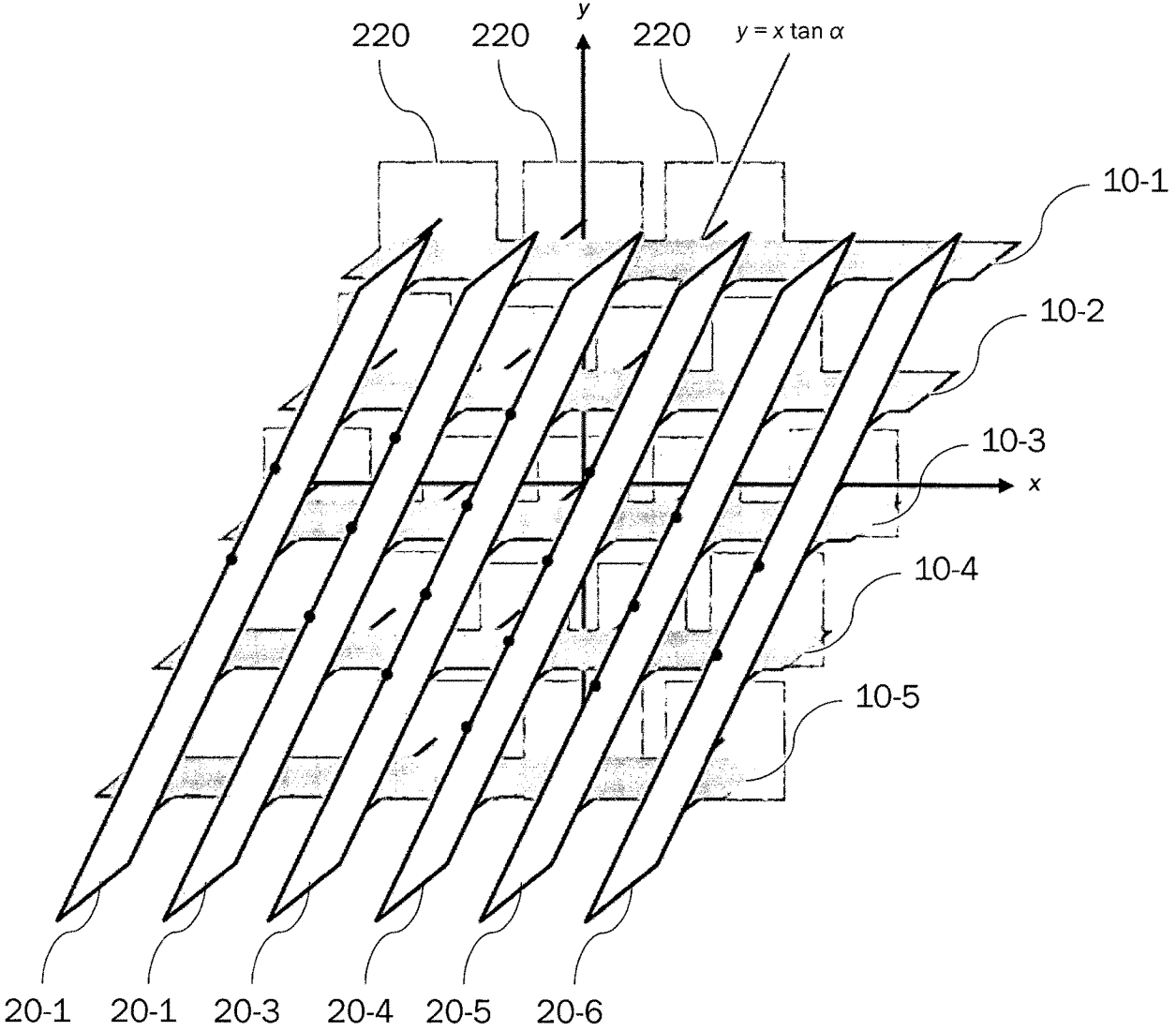

In the example of FIG. 4, the beamforming network comprises 5 beamforming sub-networks 10-1, . . . , 10-5 in the first set of beamforming sub-networks and 6 beamforming sub-networks 20-1, . . . , 20-6 in the second set of beamforming sub-networks. This corresponds to a choice of $M_1=6$.

The $m_1$-th beamforming sub-network 20-$m_1$ of the second set of beamforming sub-networks interconnecting Q homologue ports of the first set of beamforming sub-networks has a third number Q of (used) output ports. As such, the $m_1$-th beamforming sub-network 20-$m_1$ of the second set of beamforming sub-networks is associated with beam direction $u_{m_1}$ in the first set of beam directions $\{u_1, \ldots u_{M_1}\}$. Each of its output ports is coupled to that input port of a respective beamforming sub-network 10 in the first set of beamforming sub-networks that corresponds to the associated beam direction $u_{m_1}$. The third number Q of output ports corresponds to the number of beamforming sub-networks 10 in the first set of beamforming sub-networks, which is also the number of linear sub-arrays 210 in the antenna array 200.

The $m_1$-th beamforming sub-network of the second set of beamforming sub-networks further has a number of (used) inputs equal to $M_2$ ($m_1$). That is, the number of beams generated by a beamforming sub-network 20 of the second set of beamforming sub-networks may not be equal for all said beamforming sub-networks.

The inputs are labelled $m_1$, $m_2$ with $m_2=1, \ldots, M_2$ ($m_1$) and the outputs are labelled $m_1$, q with $q=1, \ldots, Q$. The additional index $m_1$ is introduced both for inputs and outputs to obtain a unique and ordered addressing of the inputs and outputs of the second set of beamforming matrices.

As was the case for the beamforming sub-networks 10 in the first set of beamforming sub-networks, each beamforming sub-network 20 may have additional output ports that are terminated and not coupled to one of the beamforming sub-networks 10 in the first set of beamforming sub-networks. Further, each beamforming sub-network 20 may have additional input ports that are terminated.

For each beamforming sub-network 20 in the second set of beamforming sub-networks, a gradient (with respect to a location of linear sub-arrays, e.g., with respect to the y coordinate) of the transmission phase between a given input port and a given output port is constant along a direction perpendicular to the directions of the linear sub-arrays (i.e., when going from one linear sub-array to another, e.g., along the y axis). That is, defining the transmission phase between the $m_2$-th input port of the $m_1$-th beamforming sub-network 20-$m_1$ in the second set of beamforming sub-networks and the q-th output port of the $m_1$-th beamforming sub-network 20-$m_1$ as $\varphi_{m_1,q|m_1,m_2}^{(2)}$, the gradient $(\varphi_{m_1,q|m_1,m_2}^{(2)}-\varphi_{m_1,q-1|m_1,m_2}^{(2)})/(y_q-y_{q-1})$ is constant along the y axis (wherein the y axis is an example of a direction in the plane of the planar array that is perpendicular to the extending direction of the linear sub-arrays 210). That is, this gradient is independent of the output port number q.

For example, for each beamforming sub-network 20 in the second set of beamforming sub-networks, the transmission phase between a given input port and a given output port of the beamforming sub-network 20 may depend linearly on a position, along a direction extending in perpendicular to the linear sub-arrays, of the linear sub-array 210 associated with the beamforming sub-network 10 in the first set of beamforming sub-networks to an input port of which the given output port is coupled. In other words, $\varphi_{m_1,q|m_1,m_2}^{(2)} \propto y_q$. This is the case if, for an $m_1$-th beamforming sub-network 20-$m_1$ in the second set of beamforming sub-networks, the transmission phase $\varphi_{m_1,q|m_1,m_2}^{(2)}$ between an $m_2$-th input port and a q-th output port that is coupled to the q-th beamforming sub-network 10-$q$ in the first set of beamforming sub-networks that is associated with a q-th linear sub-array 210-$q$ is given by $\varphi_{m_1,q|m_1,m_2}^{(2)}=-c_{m_1,m_2}y_q+\varphi_{m_1,m_2}$ where $c_{m_1,m_2}$ is a constant depending on a beam direction to which the $m_2$-th input port corresponds, $y_q$ is the position of the q-th linear sub-array 210-$q$ in a direction perpendicular to the linear sub-arrays 210, and $\varphi_{m_1,m_2}$ is a transmission phase offset.

This assumes that each $m_1$-th beamforming sub-network 20 in the second set of beamforming sub-networks is adapted to generate, via the beamforming sub-networks 10 in the first set of beamforming sub-networks and their associated linear sub-arrays 210, fan beams along respective beam directions in a second set of beam directions $\{v_{m_1,1}, \ldots, v_{m_1,M_2(m_1)}\}$ where $m_1=1, \ldots, M_1$. Therein, each of the input ports of the beamforming sub-networks 20 in the second set of beamforming sub-networks corresponds to a respective beam direction in the second set of beam directions $\{v_{m_1,1}, \ldots, v_{m_1,M_2(m_1)}\}$.

Figure 6:
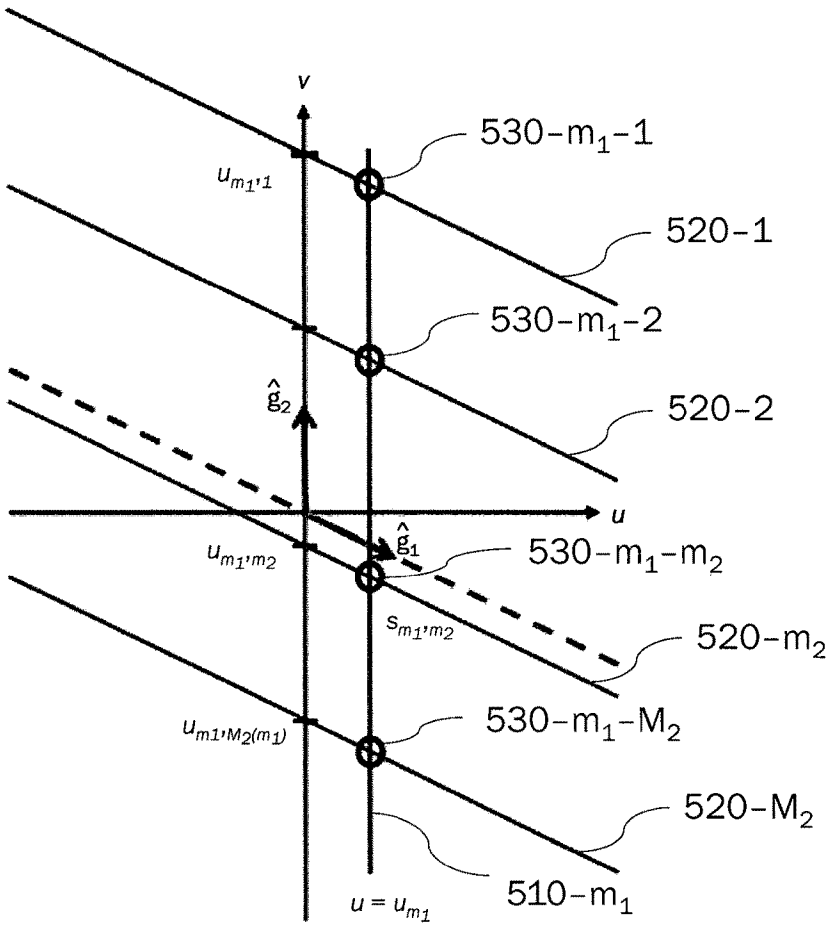

In a preferred implementation, the transmission phase between the beam port $m_2$ (i.e., $m_1$, $m_2$) and the output ports q(i.e., $m_1$, q) of said $m_1$-th beamforming matrix 20-$m_1$ of the second set of beamforming matrices is designed in such a way to give $$\varphi_{m_1,q|m_1,m_2}^{(2)}=-k_0 v_{m_1,m_2} y_q+\varphi_{m_1,m_2} \tag{16}$$

where $v_{m_1,m_2}$ corresponds to a direction cosine of the beam direction to which the $m_2$-th input port corresponds. This is equivalent to say that, assuming the linear sub-arrays collapsed on the y axis at the coordinate $y_q$, a $m_1$-th beamforming matrix 20-$m_1$ of the second set of beamforming matrices is designed to generate a set of $M_2$ ($m_1$) fan beams crossing the direction cosines coordinate axis v at $v=v_{m_1,m_2}$. The fan beams generated by said beamforming network would exhibit a fan aligned along a direction perpendicular to the line of reference sub-array phase centers $x_{0q}$. An example of such fan beams 520-1, . . . , 520-$M_2$ is schematically illustrated in FIG. 6. The resulting steering directions $s_{m_1,m_2}$ 530-$m_1$-$m_2$ where $1 \le m_2 \le M_2$ can be obtained by intersections of the fan beams 520-$m_2$ with fan beam 510-$u_1$.

The used outputs of the second set of beamforming sub-networks are orderly interconnected with the used inputs of the first set of beamforming sub-networks. Output $m_1$, q of the $m_1$-th beamforming sub-network 20-$m_1$ of the second set of beamforming matrices is interconnected to input $m_1$ of the q-th beamforming sub-network 10-$q$ of the first set of beamforming matrices.

The transmission phase of the cascaded beamforming sub-networks (beamforming matrices) of the second and first set is then given by $$\varphi_{p,q|m_1,m_2}=\varphi_{p,q|m_1,q}^{(1)}+\varphi_{m_1,q|m_1,m_2}^{(2)}=-k_0[u_{m_1}(x_{p,q}-x_{0q})+v_{m_1,m_2}y_q]+\vartheta_{m_1,q}\vartheta_{m_1,m_2} \tag{17}$$

If $\vartheta_{m_1,q}$ is kept constant for the same beam port $m_1$ across the first layer of sub-array beamformers (the first set of beamforming sub-networks), $$\varepsilon_{m_1,q}=\vartheta_{m_1} \tag{18}$$

and the reference sub-array phase centers $x_{0q}$ lie on a line making an angle $\alpha$ with the x axis (i.e., not parallel to the x axis), $$x_{0q}=\cot\alpha y_q \tag{19}$$

then $$\varphi_{p,q|m_1,m_2}=-k_0[u_{m_1}x_{p,q}+(v_{m_1,m_2}-u_{m_1}\cot\alpha)y_q]+\vartheta_{m_1}+\vartheta_{m_1,m_2} \tag{20}$$

From Equation (20) it can be derived that the steering direction $s_{m_1,m_2}$ of the beam generated from beam port $m_1$, $m_2$ satisfies the following condition $$s_{m_1,m_{2=u}m_1}\hat{x}+(v_{m_1,m_2}-u_{m_1}\cot\alpha)\hat{y} \tag{21}$$

Figure 7:
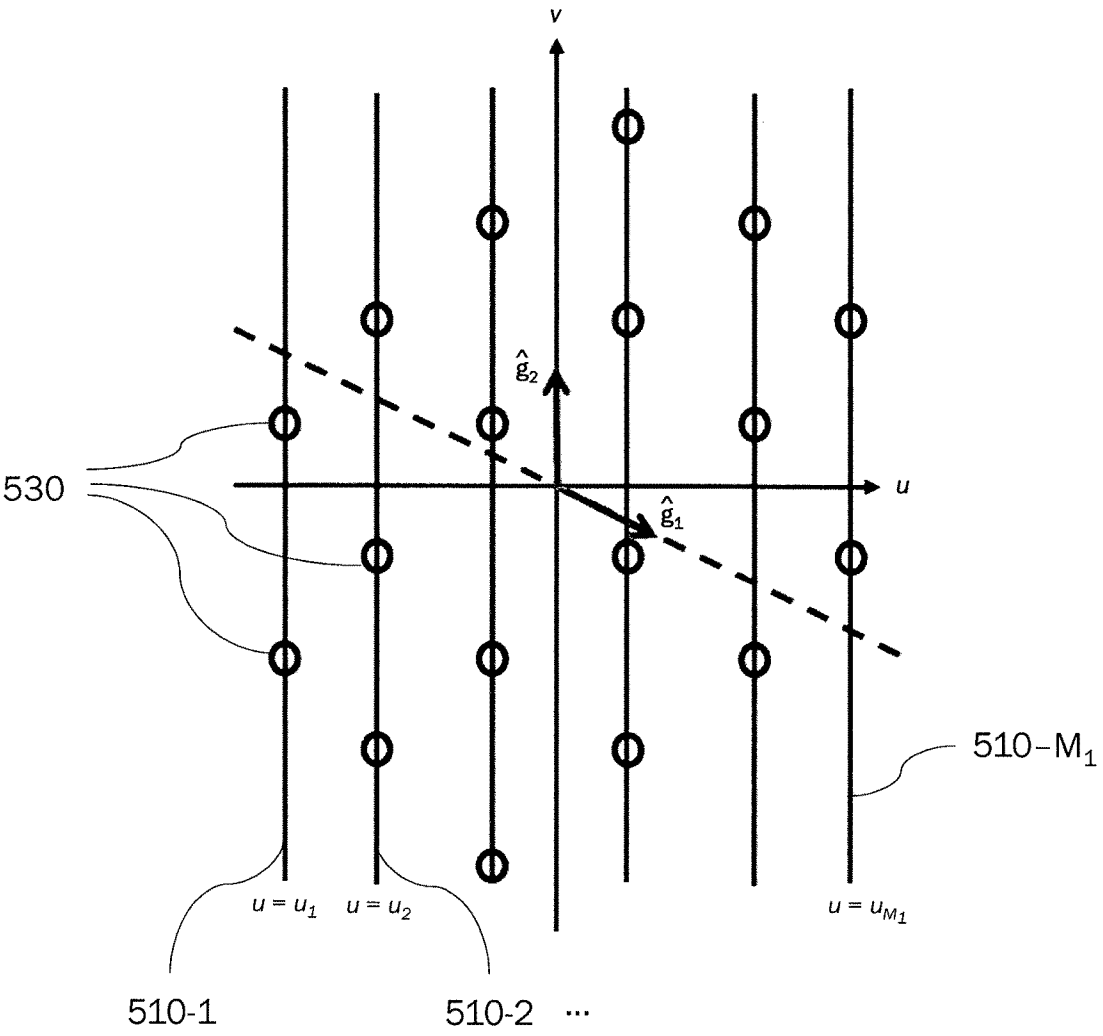

Overall, a number of beams equal to $$M=\Sigma_{m_1=1}^{M_1}M_2(m_1) \tag{22}$$

is generated. Their steering directions 530 are schematically illustrated in FIG. 7. These steering directions 530 are obtained with the topology of beamforming matrices as shown in the example of FIG. 4 and the fan beam steering directions shown in the examples of FIG. 5 and FIG. 6.

It is worth noting that phases of the linear sub-arrays described in Equations (15) and (17) are made explicit as functions of the sub-array element positions. In case the linear sub-arrays would be identical as well as the relevant first set of beamformers, the reference line of sub-array phase centers would take into account the reciprocal translation along the x axis.

FIG. 8A, FIG. 8B, FIG. 9A and FIG. 9B show an example of a multibeam antenna and a beamforming network therefor for generating of a high number of beams, e.g., from a geostationary satellite communication system, according to an example implementation of the first embodiment. Further details are given below.

Second Embodiment

In another embodiment of the disclosure, a more general beam forming decomposition can be introduced that allows one to obtain for each beam a desired beam steering and a desired spatial beam dimension. Only differences with respect to the first embodiment will be described. The array antenna may be the same or of the same type as in the first embodiment.

In this embodiment, the linear sub-arrays are individually interconnected to a first set of beamforming matrices collimated to generate a first set of $M_1$ fan beams along the direction cosines coordinates $u=u_{m_1}$, where the fan beams have a beam-width proportional to $\Delta u_{m_1}$ along the u axis.

In this embodiment, the transmission coefficient between the beam port $m_1$ and the element ports p of the q-th beamforming sub-network (beamforming matrix) 10-$q$ in the first set of beamforming sub-networks is generically indicated by $t_{p,q|m_1,q}^{(1)}$.

Assuming (without intended limitation) that each q-th sub-array is linear and aligned along a line parallel to the x axis, and assuming the amplitude and phase excitations $t_{p,q|m_1,q}^{(1)}$, each sub-array excited at the input port $m_1$ generates a fan beam steered along the direction $u_{m_1}$ of beam-width proportional to $\Delta u_{m_1}$. The input ports of the beamforming networks of the first set of beamforming networks having same port label $m_1$ are considered homologue (e.g., in the sense that they generate collimated beams from different sub-arrays).

The first set of beamforming matrices is interconnected to a second set of beamforming matrices. Therein, a beamforming matrix of the second set of beamforming matrices is interconnected to all homologue input ports of the first set of beamforming matrices, as in the first embodiment.

The $m_1$-th beamforming matrix of the second set of beamforming matrices has a transmission coefficient between the beam port $m_2$ (i.e., $m_1$, $m_2$) and the output ports q (i.e., $m_1$, q) of said $m_1$-th beamforming matrix of the second set of beamforming matrices that is indicated by $t_{m_1,q|m_1,m_2}^{(2)}$.

These transmission coefficients are such that, considering the linear sub-arrays collapsed on the y axis at the coordinate $y_q$, a $m_1$-th beamforming matrix of the second set of beamforming matrices is designed to generate a set of $M_2$ ($m_1$) fan beams crossing the direction cosines coordinate axis v at $v=v_{m_1,m_2}$ and there exhibiting a beam-width $\Delta v_{m_1,m_2}$.

Output $m_1$, q of the $m_1$-th beamforming matrix of the second set of beamforming matrices is interconnected to input $m_1$ of the q-th beamforming matrix of the first set of beamforming matrices.

The transmission coefficients of the cascaded beamforming matrices of the second and first set is given by $$t_{p,q|m_1,m_2}=t_{p,q|m_1,q}^{(1)}\times t_{m_1,q|m_1,m_2}^{(2)} \tag{23}$$

The overall effect is that from beam port $m_1$, $m_2$ a beam is obtained pointing toward the steering direction $s_{m_1,m_2}$ with $$s_{m_1,m_2}=u_{m_1}\hat{x}+(v_{m_1,m_2}-u_{m_1}\cot\alpha)\hat{y} \tag{24}$$

Furthermore the beam will exhibit a beam-width $\Delta u_{m_1}$ along the u axis and $\Delta v_{m_1,m_2}$ along the v axis.

A proper choice of the design variables $u_{m_1}$, $\Delta u_{m_1}$, $v_{m_1,m_2}$, and $\Delta v_{m_1,m_2}$ allows one to adapt the multibeam coverage to a broad range of applications.

The (linear) beamforming sub-networks of the first and second sets of beamforming sub-networks of the first embodiment can be realized in various radio frequency and microwave technologies (e.g., Butler matrices, Nolen/Blass beamformers, Rotman lenses, etc.). Their main function is individual beam steering (i.e., a desired phase response with constant amplitude distribution from the input port to the output port).

In the second embodiment, the linear beamforming sub-networks of the first and second sets of beamforming sub-networks aim at obtaining a desired beam steering together with a desired individual beam width. This objective can be realized in various radio frequency and microwave technologies (e.g., Nolen/Blass beamformers, Rotman lenses, etc.).

For both the first and second embodiment, a digital implementation of such (linear) beamforming sub-networks can benefit of the achievable high grade of microelectronics integration. A single Application Specific Integrated Circuit (ASIC) can integrate all the identified building blocks in a single device and internally route the signal flow accordingly to the used antenna architecture. Furthermore, the same device can be used for transmit and receive.

Next, technical results of embodiments of the disclosure will be described.

The solution according to the present disclosure has a large number of possible applications. Without intended limitation, embodiments of the present disclosure can be applied for multibeam generation of a high number of beams for a geostationary satellite communication system, or multibeam generation of a high number of beams with optimized beam dimensions for a low Earth orbit satellite communication system.

In the case of geostationary satellites a global multibeam coverage is typically required to fill the Earth with a regular multibeam lattice resembling a cellular wireless network. For gain optimization purposes the best beam lattice to select is a regular lattice with equilateral triangular base (where it is assumed that the direct radiating array generates circular beams).

Figure 8B:
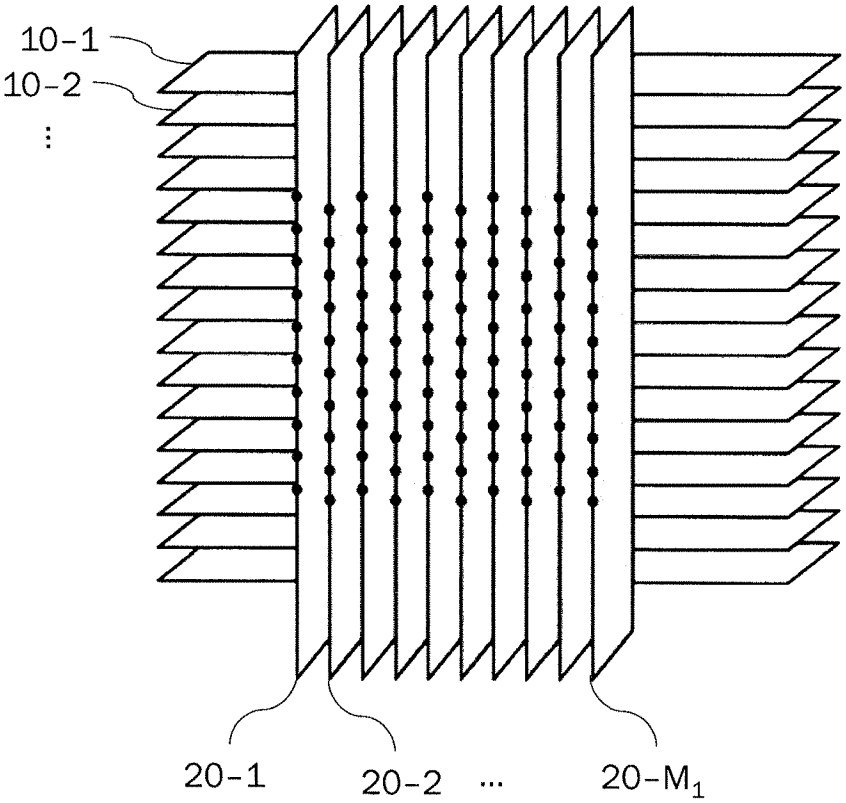
Figure 8A:
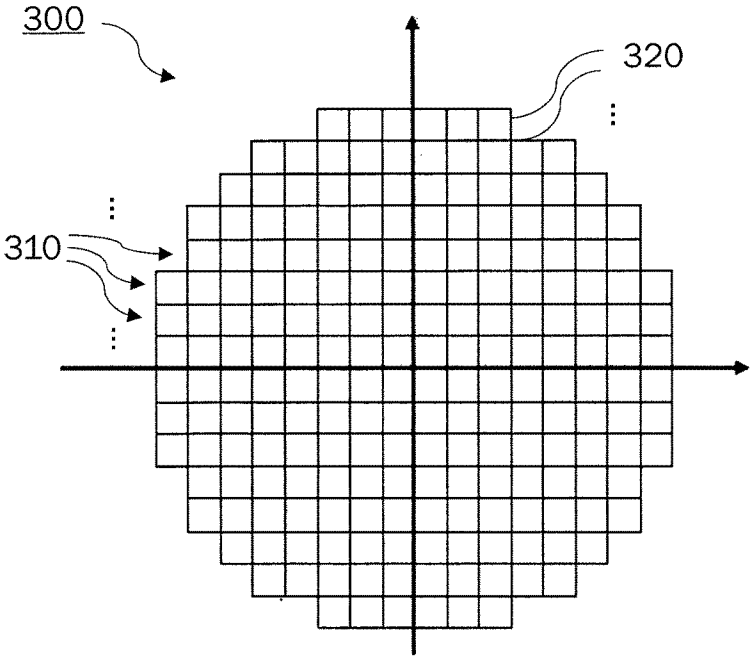

FIG. 8A schematically shows an example of a direct radiating array 300 with square elements 320 disposed on a periodic array (of linear sub-arrays 310) with square base. The square elements 320 advantageously allow one to completely fill the radiating aperture while they are still suitable for generating circular polarizations. While the array base vectors are a square, it is desirable to have a beams' lattice base that is an equilateral triangle. An example of a beamforming network according to the first embodiment for this radiating array 300 is schematically shown in FIG. 8B. This beamforming network comprises beamforming sub-networks 10-1, 10-2, . . . in a first set of (horizontal) beamforming sub-networks and beamforming sub-networks 20-1, 20-2, . . . , 20-$M_1$ in a second set of (vertical) beamforming sub-networks. There is one horizontal beamforming sub-network 10 for each linear sub-array 310 of the radiating array 300.

The radiating array 300 of FIG. 8A can be thought to be decomposed in horizontal linear sub-arrays 310 (16 linear sub-arrays in this example). Each linear sub-array 310 is interconnected to a horizontal beamforming sub-network (beamforming matrix) 10 of the first set of beamforming sub-networks which generate a first set of $M_1$ fan beams along the direction cosines coordinates $u=u_{m_1}$. This is schematically illustrated in FIG. 9A, which example shows 10 fan beams 610-1, 610-2, . . . , 610-$M_1$ (i.e., $M_1=10$ in this example) along the u axis.

In the example of FIG. 8A, the sub-array phase centers are aligned along the x axis and the horizontal beamforming sub-networks (beamforming matrices) 10 of the first set of beamforming sub-networks are all identical to thereby reduce number of different beamformers that need to be manufactured. However, it is not necessarily the case that the beamforming sub-networks of the first set of beamforming sub-networks are identical. Some of the ports of the horizontal beamforming sub-networks 10 may be terminated to thereby match the array layout with circular rim in the present example. This array layout allows to obtain lower sidelobes.

The first set of beamforming sub-networks 10 (horizontal beamforming sub-networks in the example of FIG. 8B) is interconnected to a second set of beamforming sub-networks 20 (vertical beamforming sub-networks in the example of FIG. 8B). Therein, a beamforming sub-network 20 of the second set of beamforming matrices is interconnected to all homologue input ports of the first set of beamforming sub-networks.

The number of beamforming sub-networks 20 of the second set of beamforming sub-networks is equal to the number $M_1$ of fan beams generated by each beamforming matrix of the first set of beamforming sub-networks ($M_1=10$ in the example of FIG. 8B).

Figure 9B:
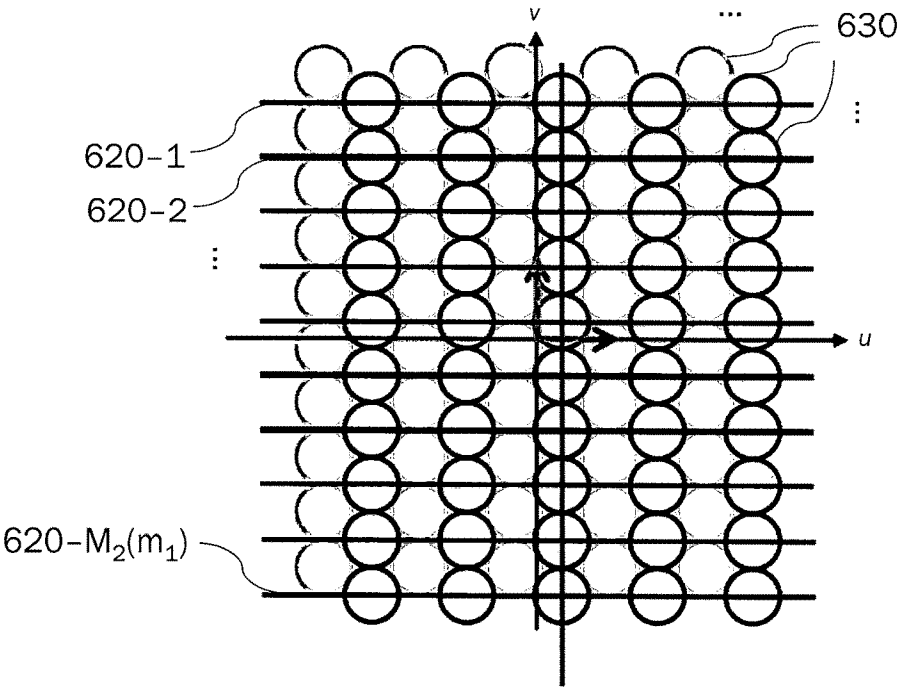
Figure 9A:
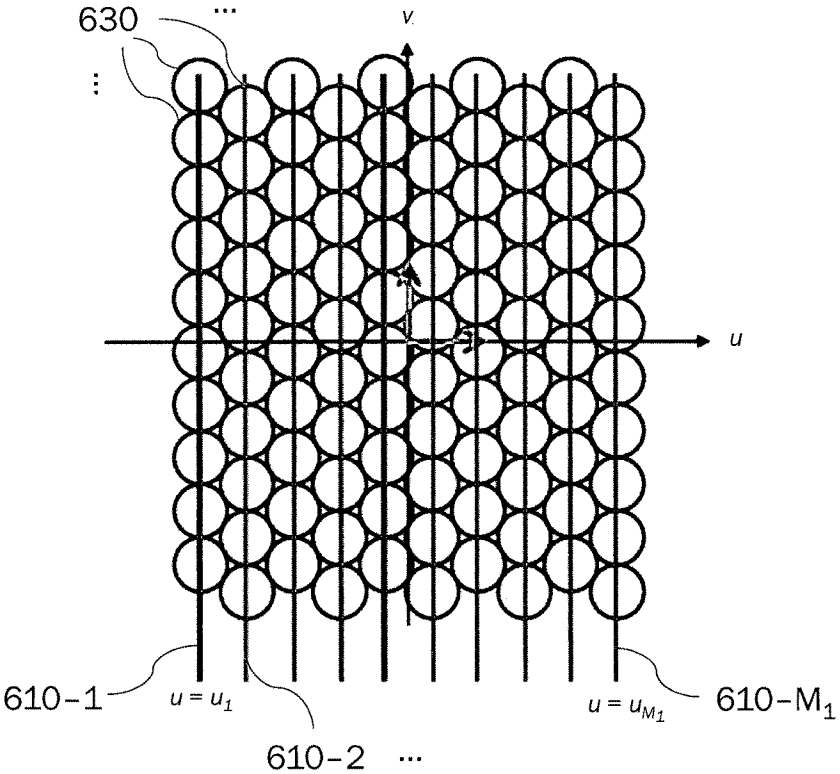

Each $m_1$-th beamforming matrix of the second set of beamforming sub-networks generates a number $M_2$ ($m_1$) of horizontal fan beams 620-1, 620-2, . . . , 620-$M_2$ ($m_1$), as shown in FIG. 9B.

In the present example, $M_2$ ($m_1$)=$M_2$=10. All the vertical beamforming sub-networks 20 can be chosen to be identical, since the present disclosure allows to arbitrarily select the fan beams pointing directions. In the example of FIG. 9B, the $m_1$-th beamforming sub-networks with $m_1$ even generate fan beams crossing the v axis at $v=v_{m_1=even,m_2}$ and the beamforming sub-networks with $m_1$ odd generate fan beams crossings the v axis at $v=-v_{m_1=odd,m_2}$. This design choice allows one to use the same beamforming matrix design for all the beamforming sub-networks 20 of the second set of beamforming sub-networks, with the odd matrices being reversed in vertical orientation. This is indicated by the alternating shading in the example of FIG. 8B.

As noted above, multibeam antennas play an important role also in low and medium Earth orbit communication satellite systems. The example that is described next addresses specific aspect of this application.

Multibeam layouts at Low Earth Orbit (LEO) satellite systems are much more difficult to design because of the considerable slant range variation from nadir to edge of coverage. At an altitude 1200 km, for example, the slant range varies 10.6 dB from nadir to 0° elevation Edge of Coverage (EOC). In order to achieve constant link margin, antenna gains should increase as a function of the angle from nadir. This can be achieved by adopting beams' sizes inversely proportional to the slant range.

Independently from the array layout, which is considered to be decomposable into an array of linear sub-arrays, an important advantage of the second embodiment of the present disclosure is the possibility of designing a non-uniform/non-periodic beam layout with high degree of flexibility in selecting the beam pointing and the beam spatial dimensions.

Figure 10B:
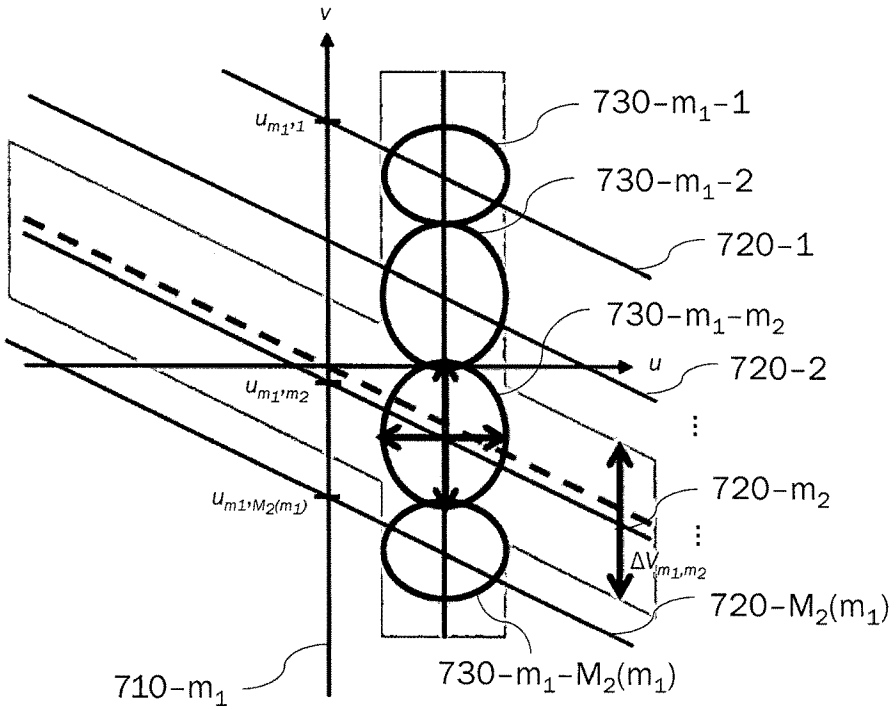
Figure 10A:
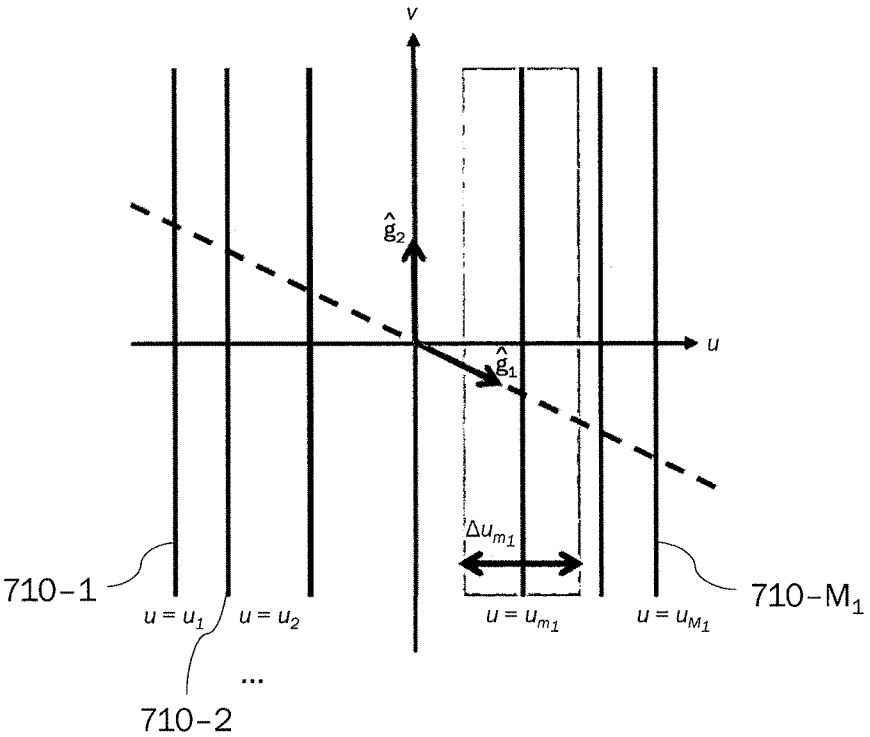
Figure 11:
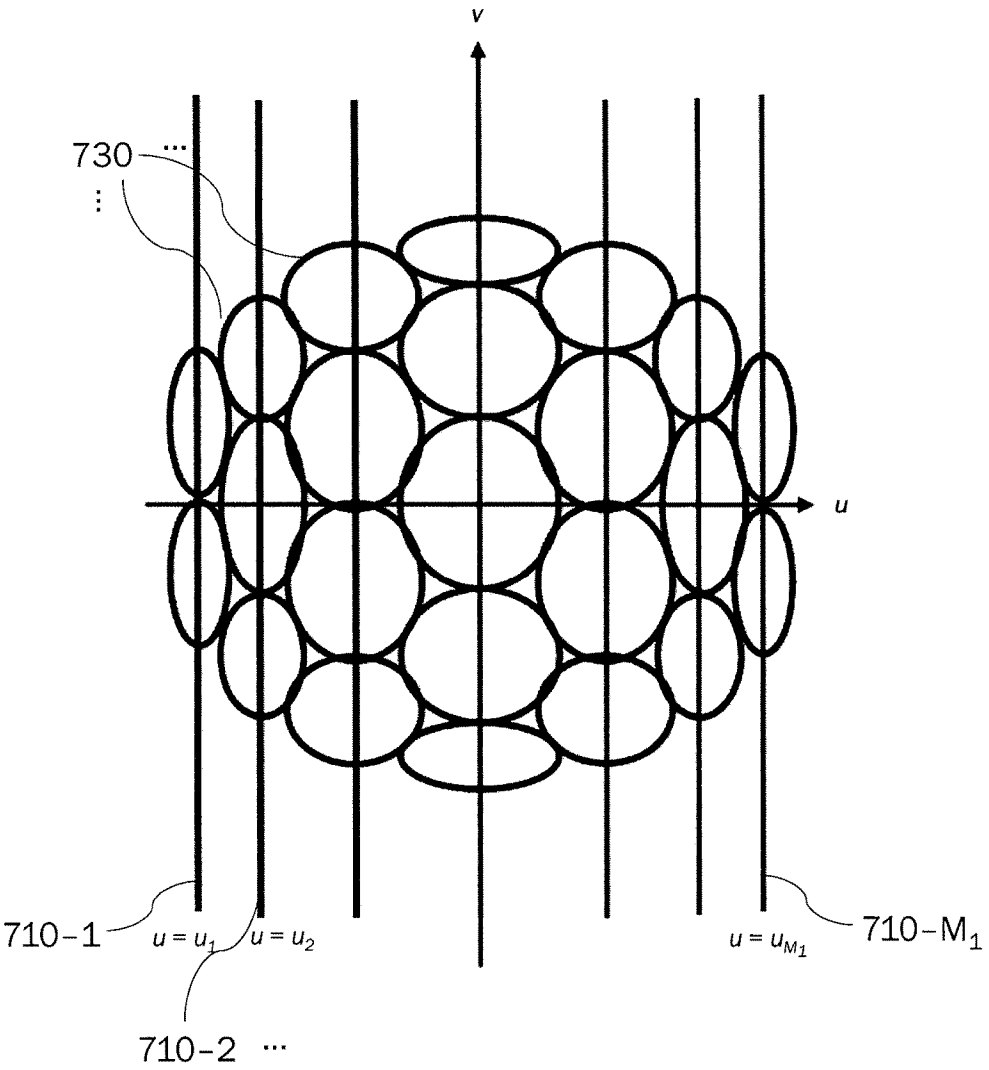

For the case of an exemplary multibeam coverage from a LEO satellite system, this flexibility is shown in the example of FIG. 10A, FIG. 10B, and FIG. 11. In this example of the second embodiment, the linear sub-arrays are individually interconnected to a first set of beamforming sub-networks collimated to generate a first set of $M_1$ fan beams 710-1, 710-2, . . . , 710-$M_1$ along the direction cosines coordinates $u=u_{m_1}$, where the fan beams have a beam-width proportional to $\Delta u_{m_1}$ along the u axis. This is schematically illustrated in FIG. 10A.

The $m_1$-th beamforming sub-network of the second set of beamforming sub-networks is designed to generate a set of $M_2$ ($m_1$) fan beams 720-1, 720-2, . . . , 720-$m_2$, . . . , 720-$M_2$ ($m_1$) crossing the direction cosines coordinate axis v at $v=v_{m_1,m_2}$ and there exhibiting a beam-width $\Delta v_{m_1,m_2}$. This is schematically illustrated in FIG. 10B. The overall effect is that, from beam port $m_1$, $m_2$, a beam 730-$m_1$-$m_2$ is obtained pointing towards the desired steering direction with a beam width $\Delta u_{m_1}$ along the u axis and along the v axis. For the $m_1$-th beamforming sub-network in the first set of beamforming sub-networks, a set of beams 730-$m_1$-1, 730-$m_1$-2, . . . , 730-$m_1$-$m_2$, . . . , 730-$m_1$-$M_2$($m_1$) with corresponding beam widths is obtained.

In this example the design variables $\Delta u_{m_1}$, $\Delta u_{m_1}$, $v_{m_1,m_2}$, and $\Delta v_{m_1,m_2}$ with $m_1=1, \ldots, M_1$ and $m_2=1, \ldots, M_2$ ($m_1$) can be optimized to obtain the LEO multibeam coverage with the required beam gain adaptation to an average slant range within the beam. An example of the resulting set of beams 730 is illustrated in FIG. 11.

The present disclosure further relates to a multibeam antenna comprising a beamforming network as described above and the associated array antenna, wherein the beamforming network and the antenna elements of the array antenna are interconnected as described above.

The beamforming networks and their beamforming sub-networks according to embodiments of the disclosure may be implemented in microwave circuitry and/or microelectronic circuitry.

It should be noted that the apparatus features described above may correspond to respective method, system, and computer program features that may not be explicitly described, for reasons of conciseness, and vice versa. The disclosure of the present document is considered to extend also to such method, system, and computer program features, and vice versa. For example, such method may include any or each of the processes described above, and such computer program may be adapted to cause a processor to perform any or each of these processes. The present disclosure should further be construed to be related to a computer-readable medium storing such computer program.

It should further be noted that the description and drawings merely illustrate the principles of the proposed method and system. Those skilled in the art will be able to implement various arrangements that, although not explicitly described or shown herein, embody the principles of the disclosure and are included within its spirit and scope. Furthermore, all examples and embodiment outlined in the present document are principally intended expressly to be only for explanatory purposes to help the reader in understanding the principles of the proposed method and system. Furthermore, all statements herein providing principles, aspects, and embodiments of the disclosure, as well as specific examples thereof, are intended to encompass equivalents thereof.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A beamforming network for use with a plurality of antenna elements arranged in a planar array of linear sub-arrays, comprising:

a first set of beamforming sub-networks; and a second set of beamforming sub-networks, wherein:

each beamforming sub-network in the first set of beamforming sub-networks is associated with a respective one of the linear sub-arrays and has a first number of output ports corresponding to the number of antenna elements in the associated linear sub-array, and each of the output ports is adapted to be coupled to a respective one of the antenna elements in the respective linear sub-array, each beamforming sub-network in the first set of beamforming sub-networks is adapted to generate, via the associated linear sub-array, fan beams along respective beam directions in a first set of beam directions, and has a second number of input ports, wherein each of the input ports corresponds to a respective beam direction in the first set of beam directions, the number of beamforming sub-networks in the second set of beamforming sub-networks corresponds to the number of beam directions in the first set of beam directions and each beamforming sub-network in the second set of beamforming sub-networks is associated with a respective one of the beam directions in the first set of beam directions, and each beamforming sub-network in the second set of beamforming sub-networks has a third number of output ports corresponding to the number of beamforming sub-networks in the first set of beamforming sub-networks, and for each beamforming sub-network in the second set of beamforming sub-networks, each of the output ports is coupled to an input port of a respective beamforming sub-network in the first set of beamforming sub-networks that corresponds to the associated beam direction.

2. The beamforming network according to claim 1, wherein for each beamforming sub-network in the first set of beamforming sub-networks a gradient of a transmission phase between a given input port and a given output port along a direction of the respective associated linear sub-array is constant.

3. The beamforming network according to claim 1, wherein for each beamforming sub-network in the first set of beamforming sub-networks a transmission phase between a given input port and a given output port of the beamforming sub-network depends linearly on a position of the respective antenna element coupled to an output port along a direction extending in parallel to the linear sub-arrays.

4. The beamforming network according to claim 1, wherein for a q-th beamforming sub-network in the first set of beamforming sub-networks a transmission phase $\varphi_{p,q|m_1,q}^{(1)}$ between an $m_1$-th input port and an output port coupled to a p-th antenna element in the associated linear sub-array is given by $$\varphi_{p,q|m_1,q}^{(1)}=-c_{m_1}(x_{p,q}-x_{0,q})+\varphi_{m_1,q}$$

where $c_{m_1}$ is a constant depending on the beam direction to which the $m_1$-th input port corresponds, $x_{p,q}$ is the position of the p-th antenna element in the q-th linear sub-array, $x_{0,q}$ is a reference position for the q-th linear sub-array, and $\varphi_{m_1,q}$ is a transmission phase offset.

5. The beamforming network according to claim 1, wherein for each beamforming sub-network in the second set of beamforming sub-networks a gradient of a transmission phase between a given input port and a given output port along a direction perpendicular to directions of the linear sub-arrays is constant.

6. The beamforming network according to claim 1, wherein for each beamforming sub-network in the second set of beamforming sub-networks a transmission phase between a given input port and a given output port of the beamforming sub-network depends linearly on a position of the linear sub-array associated with the beamforming sub-network in the first set of beamforming sub-networks to an input port of which the given output port is coupled along a direction extending in perpendicular to the linear sub-arrays.

7. The beamforming network according to claim 1, wherein:

each beamforming sub-network in the second set of beamforming sub-networks is adapted to generate, via the beamforming sub-networks in the first set of beamforming sub-networks and their associated linear sub-arrays, fan beams along respective beam directions in a second set of beam directions;

each of the input ports of the beamforming sub-networks in the second set of beamforming sub-networks corresponds to a respective beam direction in the second set of beam directions; and for an $m_1$-th beamforming sub-network in the second set of beamforming sub-networks a transmission phase $\varphi_{m_1,q|m_1,m_2}^{(2)}$ between an $m_2$-th input port and an output port coupled to the beamforming sub-network in the first set of beamforming sub-networks that is associated with a q-th linear sub-array is given by $$\varphi_{m_1,q|m_1,m_2}^{(2)}=-c_{m_1,m_2}y_q+\varphi_{m_1,m_2}$$

where $c_{m_1,m_2}$ is a constant depending on a beam direction to which the $m_2$-th input port corresponds, $y_q$ is the position of the q-th linear sub-array in a direction perpendicular to the linear sub-arrays, and $\varphi_{m_1,m_2}$ is a transmission phase offset.

8. A multibeam antenna comprising the beamforming network of claim 1 and a plurality of antenna elements arranged in the planar array of linear sub-arrays, wherein the output ports of each beamforming sub-network in the first set of beamforming sub-networks are coupled to respective corresponding antenna elements in the plurality of antenna elements.

9. The multibeam antenna according to claim 8, wherein the planar array is a sparse array.

10. The multibeam antenna according to claim 8, wherein at least one of the linear sub-arrays is a sparse array.

11. The multibeam antenna according to claim 8, wherein at least two of the linear sub-arrays are different from each other.

12. The multibeam antenna according to claim 8, wherein:

the linear sub-arrays are subdivided into two or more groups of linear sub-arrays; and linear sub-arrays are identical to each other within groups of linear sub-arrays but different from each other between groups of linear sub-arrays.

13. The multibeam antenna according to claim 8, wherein each linear sub-array is one of periodic, thinned periodic, or aperiodic.

14. The multibeam antenna according to claim 8, wherein the planar array of linear sub-arrays is one of periodic, thinned periodic, or aperiodic.

* * * * *